US010301910B2

(12) United States Patent
Whitsitt et al.

(10) Patent No.: US 10,301,910 B2
(45) Date of Patent: May 28, 2019

(54) AUTONOMOUS UNTETHERED WELL OBJECT HAVING AN AXIAL THROUGH-HOLE

(71) Applicant: Schlumberger Technology Corporation, Sugar Land, TX (US)

(72) Inventors: John Whitsitt, Houston, TX (US); Gary Rytlewski, League City, TX (US); John Wolf, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 352 days.

(21) Appl. No.: 14/918,286

(22) Filed: Oct. 20, 2015

(65) Prior Publication Data

US 2016/0108722 A1 Apr. 21, 2016

Related U.S. Application Data

(60) Provisional application No. 62/066,419, filed on Oct. 21, 2014.

(51) Int. Cl.

| | |
|---|---|
| ***E21B 33/128*** | (2006.01) |
| ***E21B 47/10*** | (2012.01) |
| ***E21B 23/01*** | (2006.01) |
| ***E21B 34/06*** | (2006.01) |
| ***E21B 23/00*** | (2006.01) |
| ***E21B 34/14*** | (2006.01) |
| *E21B 34/00* | (2006.01) |

(52) U.S. Cl.

CPC ..... *E21B 34/14* (2013.01); *E21B 2034/002* (2013.01); *E21B 2034/007* (2013.01)

(58) Field of Classification Search

None

See application file for complete search history.

(56) References Cited

U.S. PATENT DOCUMENTS

| | | | | |
|---|---|---|---|---|
| 7,775,279 | B2 | 8/2010 | Marya et al. | |
| 8,211,247 | B2 | 7/2012 | Marya et al. | |
| 9,033,041 | B2 * | 5/2015 | Baihly | E21B 23/04 166/297 |
| 9,677,375 | B2 * | 6/2017 | Fitzhugh | E21B 23/06 |

(Continued)

OTHER PUBLICATIONS

PCT/US2013/46071 International Search Report and Written Opinion, dated Sep. 27, 2013, 20 pgs.

(Continued)

*Primary Examiner* — Matthew R Buck
*Assistant Examiner* — Douglas S Wood

(57) ABSTRACT

An apparatus that is usable with a well includes a body, a blocking member, a sensor, a radially expandable element and a controller. The body includes a longitudinal passageway that extends through the body, and the blocking member is disposed in the passageway to check fluid from flowing in a predefined direction through the passageway. The sensor is disposed on the body to sense a property of an environment of the string as the object is being communicated through the passageway; the radially expandable element is disposed on the body; and the controller is disposed on the body to selectively autonomously control the expandable element to land the body in a downhole restriction in response to the sensing.

19 Claims, 8 Drawing Sheets

(56) References Cited

U.S. PATENT DOCUMENTS

| | | | | |
|---|---|---|---|---|
| 2005/0241824 | A1* | 11/2005 | Burris, II | E21B 23/00 166/255.1 |
| 2011/0056692 | A1 | 3/2011 | Lopez de Cardenas et al. | |
| 2011/0284240 | A1 | 11/2011 | Chen et al. | |
| 2012/0085538 | A1 | 4/2012 | Guerrero et al. | |
| 2014/0076542 | A1 | 3/2014 | Whitsitt et al. | |
| 2015/0361747 | A1* | 12/2015 | Lafferty | E21B 34/14 166/373 |
| 2016/0084075 | A1* | 3/2016 | Ingraham | E21B 23/10 166/255.1 |

OTHER PUBLICATIONS

GC Application No. 2013-24664, First Examination Report, dated Jul. 21, 2016, 5 pgs.
U.S. Appl. No. 62/162,440, filed May 15, 2015.

* cited by examiner

AUTONOMOUS UNTETHERED WELL OBJECT HAVING AN AXIAL THROUGH-HOLE

CROSS-REFERENCE TO RELATED APPLICATIONS

This application claims the benefit under 35 U.S.C. § 119(e) to U.S. Provisional Patent Application Ser. No. 62/066,419 entitled, "AUTONOMOUS UNTETHERED OBJECT WITH A THRU-HOLE," which was filed on Oct. 21, 2014, and is hereby incorporated by reference in its entirety.

BACKGROUND

For purposes of preparing a well for the production of oil or gas, at least one perforating gun may be deployed into the well via a conveyance mechanism, such as a wireline or a coiled tubing string. The shaped charges of the perforating gun(s) are fired when the gun(s) are appropriately positioned to perforate a casing of the well and form perforating tunnels into the surrounding formation. Additional operations may be performed in the well to increase the well's permeability, such as well stimulation operations and operations that involve hydraulic fracturing. The above-described perforating and stimulation operations may be performed in multiple stages of the well.

The above-described operations may be performed by actuating one or more downhole tools. A given downhole tool may be actuated using a wide variety of techniques, such dropping a ball into the well sized for a seat of the tool; running another tool into the well on a conveyance mechanism to mechanically shift or inductively communicate with the tool to be actuated; pressurizing a control line; and so forth.

SUMMARY

In accordance with an example implementation, a technique includes deploying an untethered object though a passageway of a string in a well. The untethered object has an axial through-hole, and a blocking object is disposed in the through-hole to block communication through the untethered object. The technique includes sensing a property of an environment of the string as the object is being communicated through the passageway; selectively autonomously operating the untethered object in response to the sensing; and removing the blocking object to allow communication through the untethered object.

In accordance with another example implementation, an apparatus that is usable with a well includes a body, a blocking member, a sensor, a radially expandable element and a controller. The body includes a longitudinal passageway that extends through the body, and the blocking member is disposed in the passageway to check fluid from flowing in a predefined direction through the passageway. The sensor is disposed on the body to sense a property of an environment of the string as the object is being communicated through the passageway; the radially expandable element is disposed on the body; and the controller is disposed on the body to selectively autonomously control the expandable element to land the body in a downhole restriction in response to the sensing.

In accordance with yet another example implementation, an apparatus that is usable with a well includes a string, and an untethered object that is adapted to be deployed in a passageway of the string such that the object travels in the passageway. The object includes a longitudinal passageway that extends through the object. The object further includes a degradable check valve element, a sensor, a radially expandable element and a controller. The degradable check valve element is disposed in the longitudinal passageway and is adapted to degrade in a downhole well environment at a faster rate than other components of the untethered object. The sensor senses a property of an environment of the string as the object is being communicated through the passageway of the string; and the controller is disposed on the body and is coupled to the sensor to selectively autonomously control the expandable element to land the body in a seat of the string in response to the sensing.

Advantages and other features will become apparent from the following drawings, description and claims.

DETAILED DESCRIPTION

Figure 1:
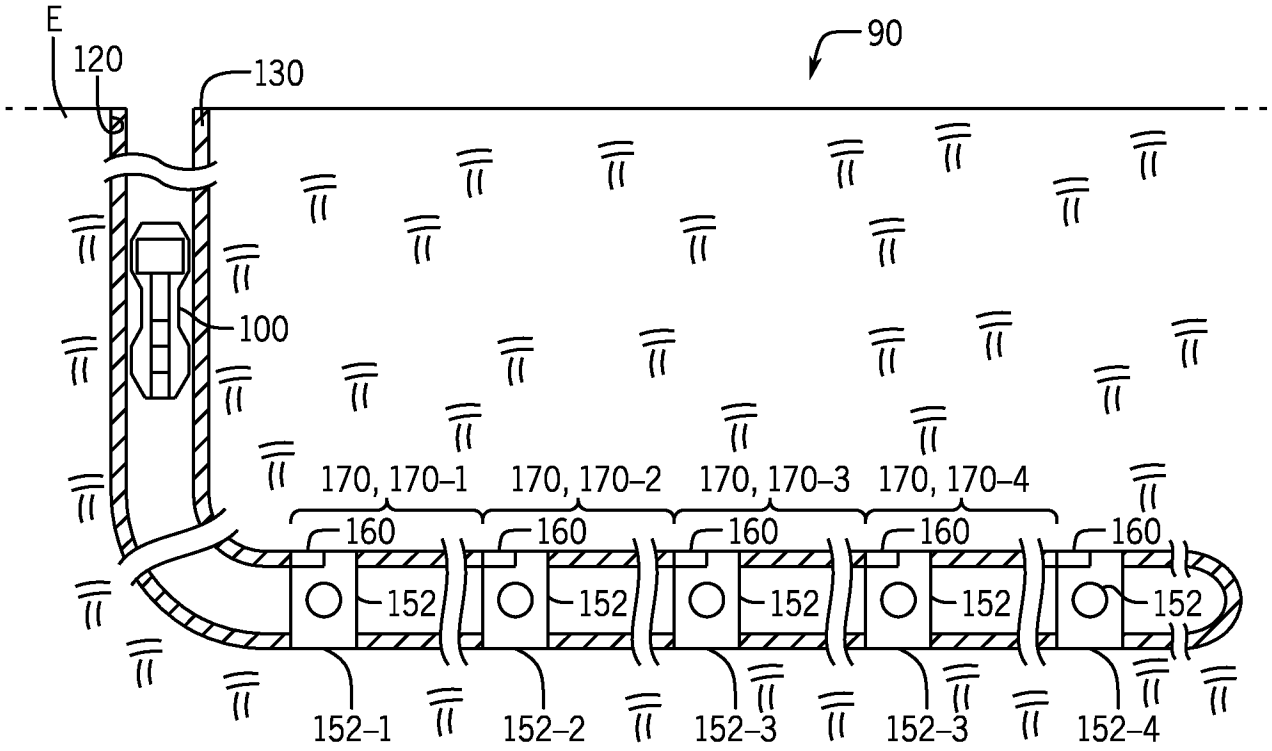
FIG. 1 is a schematic diagram of a multiple stage well according to an example implementation.

In general, systems and techniques are disclosed herein for purposes of deploying an untethered object into a well and using an autonomous operation of the object to perform a downhole operation. In this context, an "untethered object" refers to an object that travels at least some distance in a well passageway without being attached to a conveyance mechanism (a slickline, wireline, coiled tubing string, and so forth). As specific examples, the untethered object may be a dart, a ball or a bar. However, the untethered object may take on different forms, in accordance with further implementations. In accordance with some implementations, the untethered object may be pumped into the well (i.e., pushed into the well with fluid), although pumping may not be employed to move the object in the well, in accordance with further implementations.

In general, the untethered object may be used to perform a downhole operation that may or may not involve actuation of a downhole tool As just a few examples, the downhole operation may be a stimulation operation (a fracturing operation or an acidizing operation as examples); an operation performed by a downhole tool (the operation of a downhole valve, the operation of a single shot tool, or the operation of a perforating gun, as examples); the formation of a downhole obstruction; or the diversion of fluid (the diversion of fracturing fluid into a surrounding formation, for example). Moreover, in accordance with example implementations, a single untethered object may be used to perform multiple downhole operations in multiple zones, or stages, of the well, as further disclosed herein.

In accordance with example implementations, the untethered object is deployed in a passageway (a tubing string passageway, for example) of the well, autonomously senses its position as it travels in the passageway, and upon reaching a given targeted downhole position, autonomously operates to initiate a downhole operation. The untethered object is initially radially contracted when the object is deployed into the passageway. The object monitors its position as the object travels in the passageway, and upon determining that it has reached a predetermined location in the well, the object radially expands. The increased cross-section of the object due to its radial expansion may be used to effect any of a number of downhole operations, such as shifting a valve, forming a fluid obstruction, actuating a tool, and so forth. Moreover, because the object remains radially contracted before reaching the predetermined location, the object may pass through downhole restrictions (valve seats, for example) that may otherwise "catch" the object, thereby allowing the object to be used in, for example, multiple stage applications in which the object is used in conjunction with seats of the same size so that the object selects which seat catches the object.

In general, the untethered object is constructed to sense its downhole position as it travels in the well and autonomously respond based on this sensing. As disclosed herein, the untethered object may sense its position based on features of the string, markers, formation characteristics, and so forth, depending on the particular implementation. As a more specific example, for purposes of sensing its downhole location, the untethered object may be constructed to, during its travel, sense specific points in the well, called "markers" herein. Moreover, as disclosed herein, the untethered object may be constructed to detect the markers by sensing a property of the environment surrounding the object (a physical property of the string or formation, as examples). The markers may be dedicated tags or materials installed in the well for location sensing by the object or may be formed from features (sleeve valves, casing valves, casing collars, and so forth) of the well, which are primarily associated with downhole functions, other than location sensing. Moreover, as disclosed herein, in accordance with example implementations, the untethered object may be constructed to sense its location in other and/or different ways that do not involve sensing a physical property of its environment, such as, for example, sensing a pressure for purposes of identifying valves or other downhole features that the object traverses during its travel.

In accordance with example implementations that are disclosed herein, the untethered object has an axial through-hole, i.e., a passageway that extends along the object's longitudinal axis for purposes of allowing the communication of fluid and/or equipment through the object while the object is secured in place inside the tubing string (when the object is landed in a seat, for example).

For example, the object may be deployed to secure itself at targeted downhole location to form a fluid barrier to perform a downhole operation (a fracturing operation, for example) that relies on the fluid barrier. For purposes of forming the fluid barrier, the axial through-hole of the untethered object may be initially blocked or sealed by an internal block object. The untethered object is constructed, as described herein, to allow removal of the internal blocking object after completion of the downhole operation. With the internal block object removed, fluid (produced well fluid, fluid pumped into the well, and so forth) may then be communicated through the object while the object remains in place (i.e., communication may be opened through the untethered object without the use of an operation to remove the object). Well equipment (a tubing string, for example) may also be run through the opened axial through-hole of the untethered, in accordance with example implementations.

In accordance with example implementations, axial through-hole may allow relatively easier removal of the untethered object. For example, the untethered object may be removed by running a milling tool into the well to mill out the untethered object, and due to the axial through-hole, less material is removed by the milling.

Referring to FIG. 1, as a more specific example, in accordance with some implementations, a multiple stage well 90 includes a wellbore 120, which traverses one or more formations (hydrocarbon bearing formations, for example). As a more specific example, the wellbore 120 may be lined, or supported, by a tubing string 130, as depicted in FIG. 1. The tubing string 130 may be cemented to the wellbore 120 (such wellbores typically are referred to as "cased hole" wellbores); or the tubing string 130 may be secured to the formation by packers (such wellbores typically are referred to as "open hole" wellbores). In general, the wellbore 120 extends through one or multiple zones, or stages 170 (four stages 170-1, 170-2, 170-3 and 170-4, being depicted as examples in FIG. 1) of the well 90.

It is noted that although FIG. 1 depicts a laterally extending wellbore 120, the systems and techniques that are disclosed herein may likewise be applied to vertical wellbores. In accordance with example implementations, the well 90 may contain multiple wellbores, which contain tubing strings that are similar to the illustrated tubing string 130. Moreover, depending on the particular implementation, the well 90 may be an injection well or a production well. Thus, many variations are contemplated, which are within the scope of the appended claims.

In general, the downhole operations may be multiple stage operations that may be sequentially performed in the stages 170 in a particular direction (in a direction from the toe end of the wellbore 120 to the heel end of the wellbore 120, for example) or may be performed in no particular direction or sequence, depending on the implementation.

Although not depicted in FIG. 1, fluid communication with the surrounding reservoir may be enhanced in one or more of the stages 170 through, for example, abrasive jetting operations, perforating operations, and so forth.

In accordance with example implementations, the well 90 of FIG. 1 includes downhole tools 152 (tools 152-1, 152-2, 152-3 and 152-4, being depicted in FIG. 1 as examples) that are located in the respective stages 170. The tool 152 may be any of a variety of downhole tools, such as a valve (a circulation valve, a casing valve, a sleeve valve, and so forth), a seat assembly, a check valve, a plug assembly, and so forth, depending on the particular implementation. Moreover, the tool 152 may be different tools (a mixture of casing valves, plug assemblies, check valves, and so forth, for example).

A given tool 152 may be selectively actuated by deploying an untethered object through the central passageway of the tubing string 130. In general, the untethered object has a radially contracted state to permit the object to pass relatively freely through the central passageway of the tubing string 130 (and thus, through tools of the string 130), and the object has a radially expanded state, which causes the object to land in, or, be "caught" by, a selected one of the tools 152 or otherwise secured at a selected downhole location, in general, for purposes of performing a given downhole operation. For example, a given downhole tool 152 may catch the untethered object for purposes of forming a downhole obstruction to divert fluid (divert fluid in a fracturing or other stimulation operation, for example); pressurize a given stage 170; shift a sleeve of the tool 152; actuate the tool 152; install a check valve (part of the object) in the tool 152; and so forth, depending on the particular implementation.

The untethered object 100 may be a dart, which, as depicted in FIG. 1, may be deployed (as an example) from the Earth surface E into the tubing string 130 and propagate along the central passageway of the string 130 until the untethered object 100 senses proximity of the targeted tool 152 (as further disclosed herein), radially expands and engages the tool 152. It is noted that the untethered object 100 may be deployed from a location other than the Earth surface E, in accordance with further implementations. For example, the untethered object 100 may be released by a downhole tool. As another example, the untethered object 100 may be run downhole on a conveyance mechanism and then released downhole to travel further downhole untethered.

In accordance with an example implementation, the tools 152 may be sleeve valves that may be initially closed when run into the well 90 but subsequently shifted open when engaged by the untethered object 100 for purposes for performing fracturing operations from the toe to the heel of the wellbore 120 (for the example stages 170-1, 170-2, 170-3 and 170-4 depicted in FIG. 1).

As more specific example, a given untethered object 100 may be configured, or programmed, to target the tool 152 of the last stage 170-4 and land in a seat of the tool 152 to form a corresponding fluid barrier. The tubing string 130 may then be pressurized uphole of the tool 152 of the stage 170-4 to actuate the tool 152 for purposes of performing a downhole operation. For example, for implementations in which the tool 152 are sleeve valves, the fluid barrier that is created by the untethered object 100 landing in the sleeve valve may be used to shift the sleeve valve open so that fracturing fluid may be pumped into the surrounding formation. At the conclusion of the fracturing of the associated stage 170-4, another untethered object may be deployed into the tubing string 130 to target the tool 152 associated with the next uphole stage 170-3 so that this stage 170-3 may be fractured. Therefore, the above-described sequence proceeds uphole for this example until the stage 170-1 is fractured.

For example implementations and techniques that are disclosed herein, the untethered object has an internal blocking object that is disposed in the untethered object's axial through-hole for purposes of initially configuring the untethered object 100 to prevent communication through the object 100. As a more specific example, in accordance with some implementations, the internal blocking object may be a check valve ball, which is constructed to initially reside in a check ball seat of the through-hole to prevent fluid flow through the untethered object 100 in a certain direction (prevent fluid flow in a downhole direction, for example). Therefore, when the untethered object 100 is landed at a particular position in the tubular string 130, the sealing off of the axial through-hole by the check ball element allows the portion of the string 132 above the untethered object 100 to be pressurized; and at the conclusion of the downhole operation that uses the untethered object 100, the internal blocking object may be removed for purposes of allowing fluid or well equipment communication through the untethered object 100.

In accordance with some implementations, at the internal blocking object may be constructed from a degradable or dissolvable material, which dissolves at a significantly faster rate than the body of the untethered object 100. In this manner, in accordance with example implementations, the internal blocking object may be formed from a material that degrades or dissolves within a few days, a few weeks, or a month (as examples), as compared to the other materials of the untethered object 100 that may be constructed out of non-dissolvable or non-degradable materials, which may not degrade over the course of years inside the well. The degradation of the internal blocking object, in turn, allows the collapse or disintegration of the object to permit communication through the untethered object 100.

In accordance with example implementations, the internal blocking object may be removed by a milling operation.

Thus, to target the stage 170-4, the untethered object 100 may be released into the central passageway of the tubing string 130 from the Earth surface E, travels downhole in the tubing string 130, and when the untethered object 100 senses proximity of the tool 152 of the stage 170-4 along the dart's path, the untethered object 100 radially expands to engage a dart catching seat of the tool 152. Using the resulting fluid barrier, or obstruction, that is created by the untethered object 100 landing in the tool 152, fluid pressure may be applied uphole of the untethered object 100 (by pumping fluid into the tubing string 130, for example) for purposes of creating a force to shift the sleeve of the tool 152 (a sleeve valve, for this example) to open radial fracture ports of the tool 152 with the surrounding formation in the stage 170-4.

Although examples are disclosed herein in which the untethered object 100 is constructed to radially expand at the appropriate time so that a tool 152 of the string 130 catches the untethered object 100, in accordance with other implementations disclosed herein, the untethered object 100 may be constructed to secure itself to an arbitrary position of the string 130, which is not part of a tool 152. Thus, many variations are contemplated, which are within the scope of the appended claims.

For the example that is depicted in FIG. 1, the untethered object 100 is deployed in the tubing string 130 from the Earth surface E for purposes of engaging one of the tool 152 (i.e., for purposes of engaging a "targeted tool 152"). The untethered object 100 autonomously senses its downhole position, remains radially contracted to pass through tool(s) 152 (if any) uphole of the targeted tool 152, and radially expands before reaching the targeted tool 152. In accordance with some implementations, the untethered object 100 senses its downhole position by sensing the presence of markers 160 which may be distributed along the tubing string 130.

For the specific example of FIG. 1, each stage 170 contains a marker 160, and each marker 160 is embedded in a different tool 152. The marker 160 may be a specific material, a specific downhole feature, a specific physical property, a radio frequency (RF) identification (RFID), tag, and so forth, depending on the particular implementation.

It is noted that each stage 170 may contain multiple markers 160; a given stage 170 may not contain any markers 160; the markers 160 may be deployed along the tubing string 130 at positions that do not coincide with given tools 152; the markers 160 may not be evenly/regularly distributed as depicted in FIG. 1; and so forth, depending on the particular implementation. Moreover, although FIG. 1 depicts the markers 160 as being deployed in the tools 152, the markers 160 may be deployed at defined distances with respect to the tools 152, depending on the particular implementation. For example, the markers 160 may be deployed between or at intermediate positions between respective tools 152, in accordance with further implementations. Thus, many variations are contemplated, which are within the scope of the appended claims.

In accordance with an example implementation, a given marker 160 may be a magnetic material-based marker, which may be formed, for example, by a ferromagnetic material that is embedded in or attached to the tubing string 130, embedded in or attached to a given tool housing, and so forth. By sensing the markers 160, the untethered object 100 may determine its downhole position and selectively radially expand accordingly. As further disclosed herein, in accordance with an example implementation, the untethered object 100 may maintain a count of detected markers. In this manner, the untethered object 100 may sense and log when the untethered object 100 passes a marker 160 such that the untethered object 100 may determine its downhole position based on the marker count.

Thus, the untethered object 100 may increment (as an example) a marker counter (an electronics-based counter, for example) as the untethered object 100 traverses the markers 160 in its travel through the tubing string 130; and when the untethered object 100 determines that a given number of markers 160 have been detected (via a threshold count that is programmed into the untethered object 100, for example), the untethered object 100 radially expands.

For example, the untethered object 100 may be launched into the well 90 for purposes of being caught in the tool 152-3. Therefore, given the example arrangement of FIG. 1, the untethered object 100 may be programmed at the Earth surface E to count two markers 160 (i.e., the markers 160 of the tools 152-1 and 152-2) before radially expanding. The untethered object 100 passes through the tools 152-1 and 152-2 in its radially contracted state; increments its marker counter twice due to the detection of the markers 152-1 and 152-2; and in response to its marker counter indicating a "2," the untethered object 100 radially expands so that the untethered object 100 has a cross-sectional size that causes the untethered object 100 to be "caught" by the tool 152-3.

Figure 2:
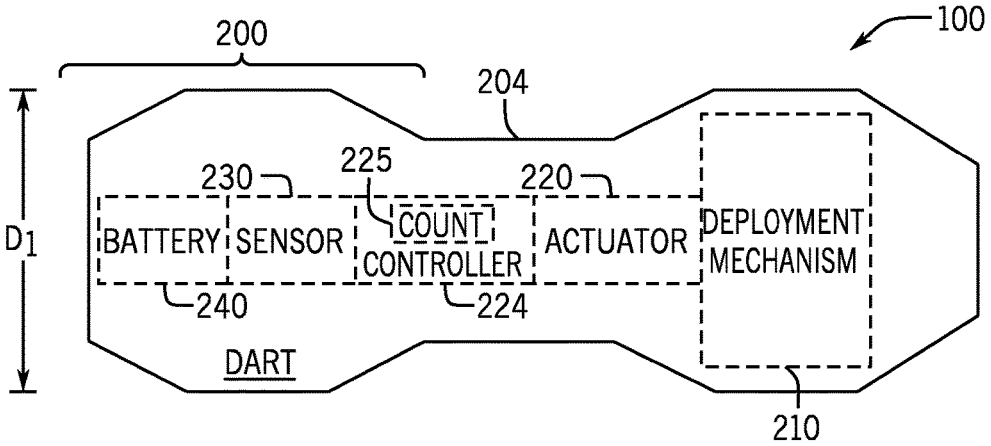
FIG. 2 is a schematic diagram of an untethered object of FIG. 1 in a radially contracted state according to an example implementation.
Figure 3:
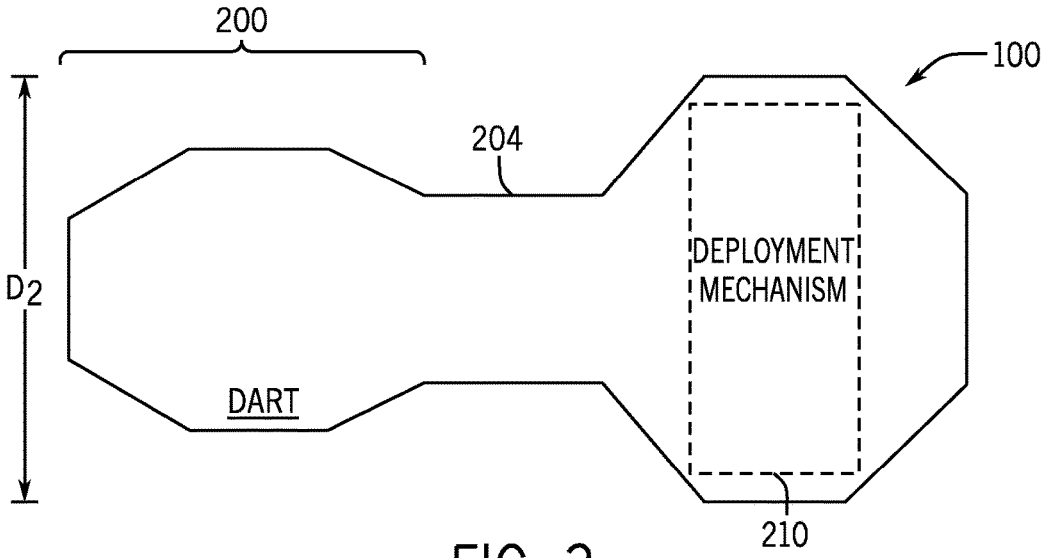
FIG. 3 is a schematic diagram of the untethered object of FIG. 1 in a radially expanded state according to an example implementation.

Referring to FIG. 2, in accordance with an example implementation, the untethered object 100 includes a body 204 having a section 200, which is initially radially contracted to a cross-sectional diameter $D_1$ when the untethered object 100 is first deployed in the well 90. The untethered object 100 autonomously senses its downhole location and autonomously expands the section 200 to a radially larger cross-sectional diameter $D_2$ (as depicted in FIG. 3) for purposes of causing the next encountered tool 152 to catch the untethered object 100.

As depicted in FIG. 2, in accordance with an example implementation, the untethered object 100 include a controller 224 (a microcontroller, microprocessor, field programmable gate array (FPGA), or central processing unit (CPU), as examples), which receives feedback as to the dart's position and generates the appropriate signal(s) to control the radial expansion of the untethered object 100. As depicted in FIG. 2, the controller 224 may maintain a count 225 of the detected markers, which may be stored in a memory (a volatile or a non-volatile memory, depending on the implementation) of the untethered object 100.

In this manner, in accordance with an example implementation, the sensor 230 provides one or more signals that indicate a physical property of the dart's environment (a magnetic permeability of the tubing string 130, a radioactivity emission of the surrounding formation, and so forth); the controller 224 use the signal(s) to determine a location of the untethered object 100; and the controller 224 correspondingly activates an actuator 220 to expand a deployment mechanism 210 of the untethered object 100 at the appropriate time to expand the cross-sectional dimension of the section 200 from the $D_1$ diameter to the $D_2$ diameter. As depicted in FIG. 2, among its other components, the untethered object 100 may have a stored energy source, such as a battery 240, and the untethered object 100 may have an interface (a wireless interface, for example), which is not shown in FIG. 2, for purposes of programming the untethered object 100 with a threshold marker count before the untethered object 100 is deployed in the well 90.

The untethered object 100 may, in accordance with example implementations, count specific markers, while ignoring other markers. In this manner, another dart may be subsequently launched into the tubing string 130 to count the previously-ignored markers (or count all of the markers, including the ignored markers, as another example) in a subsequent operation, such as a remedial action operation, a fracturing operation, and so forth. In this manner, using such an approach, specific portions of the well 90 may be selectively treated at different times. In accordance with some example implementations, the tubing string 130 may have more tools 152 (see FIG. 1), such as sleeve valves (as an example), than are needed for current downhole operations, for purposes of allowing future refracturing or remedial operations to be performed.

In accordance with example implementations, the sensor 230 senses a magnetic field. In this manner, the tubing string 130 may contain embedded magnets, and sensor 230 may be an active or passive magnetic field sensor that provides one or more signals, which the controller 224 interprets to detect the magnets. However, in accordance with further implementations, the sensor 230 may sense an electromagnetic coupling path for purposes of allowing the untethered object 100 to electromagnetic coupling changes due to changing geometrical features of the string 130 (thicker metallic sections due to tools versus thinner metallic sections for regions of the string 130 where tools are not located, for example) that are not attributable to magnets. In other example implementations, the sensor 230 may be a gamma ray sensor that senses a radioactivity. Moreover, the sensed radioactivity may be the radioactivity of the surrounding formation. In this manner, a gamma ray log may be used to program a corresponding location radioactivity-based map into a memory of the untethered object 100.

Thus, in general, the sensor(s) 230 of the untethered object 100 may be used to sense the downhole position of the object 100. The untethered object 100 may sense a property of the environment of the string in which the object 100 travels using other techniques and systems, as further described in U.S. patent application Ser. No. 13/916,657, entitled, "AUTONOMOUS UNTETHERED WELL OBJECT," which was filed on Jun. 13, 2013, and is hereby incorporated by reference in its entirety.

Figure 4:
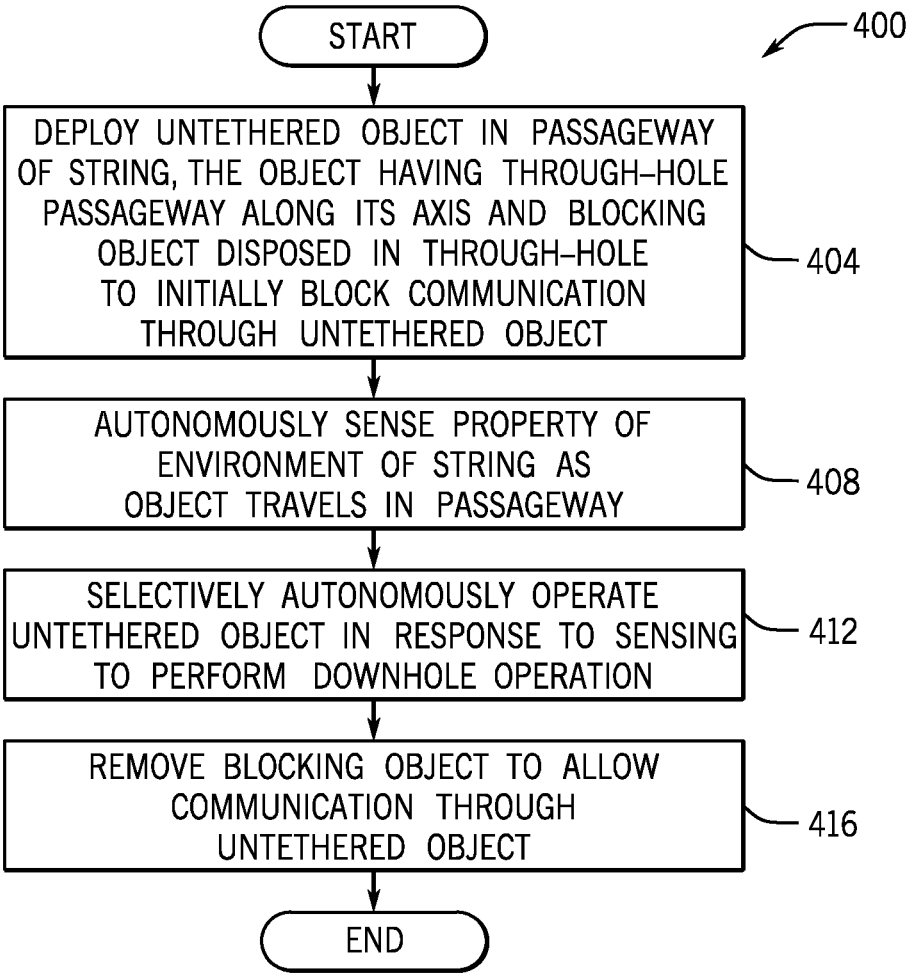
FIG. 4 is a cross-sectional diagram of a flow diagram depicting a technique to deploy and use an untethered object in a well to perform an operation in the well according to an example implementation.

Regardless of the particular sensor 230 or sensors 230 used by the untethered object 100 to sense its downhole position, in general, the untethered object 100 may perform a technique 400 that is depicted in FIG. 4. Referring to FIG. 4, in accordance with example implementations, the technique 400 includes deploying (block 404) an untethered object, such as a dart, in a passageway of a string. The untethered object has an axial through-hole, and a blocking object is disposed in the through-hole to initially block communication through the untethered object. The technique 400 includes autonomously sensing a property of the environment of the string as the object travels in the passageway of the string, pursuant to block 408, and selectively autonomously operating the untethered object in response to the sensing to perform downhole operation, pursuant to block 412. The technique 400 includes removing (block 416) the blocking object to allow communication through the untethered object.

In accordance with example implementations, the untethered object 100 may sense a pressure to detect features of the tubing string 130 for purposes of determining the location/downhole position of the untethered object 100. For example, referring to FIG. 6A, in accordance with example implementations, the untethered object 100 includes a differential pressure sensor 620 that senses a pressure in a passageway 610 that is in communication with a region 660 uphole from the untethered object 100 and a passageway 614 that is in communication with a region 670 downhole of the untethered object 100. Due to this arrangement, the partial fluid seal/obstruction that is introduced by the untethered object 100 in its radially contracted state creates a pressure difference between the upstream and downstream ends of the untethered object 100 when the untethered object 100 passes through a valve.

Figure 5:
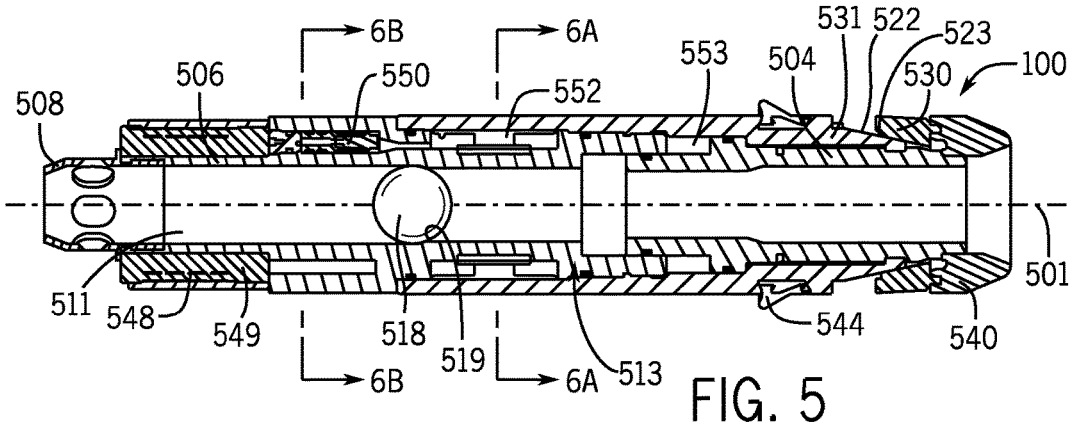
FIG. 5 is a cross-sectional view of an untethered object according to an example implementation.

FIG. 5 depicts the untethered object 100 in its contracted state, when initially deployed into the well, in accordance with example implementations. Referring to FIG. 5, the untethered object 100 includes tubular, internal housing sections 504, 506, and 508, which are connected together to form a tubular body 513 for the untethered object 100. The body 513 extends along and is coaxial with a longitudinal axis 501 of the untethered object 100 and has an through-hole 511 that extends along the longitudinal axis 501. As depicted in FIG. 5, in accordance with some implementations, the untethered object 100 includes a check ball 518 that is disposed in the through-hole 511 and resides in a restriction, or seat 519, that formed in the interior of the housing section 514 and circumscribes the longitudinal axis 501. The seat 519 is located axially downhole of the check ball 518 and configures the untethered object 100 to block a fluid flow through the through-hole 511 in the uphole to downhole direction.

The untethered object 100 further includes a sealing ring 530, which circumscribes the housing section 504. For the contracted state of the object 100 depicted in FIG. 5, the sealing ring 530 is contracted. The untethered object 100 is constructed to radially expand the sealing ring 530 for purposes of increasing the outer diameter of the object 100 to cause the object 100 to land in a seat of the tubing string 130. As an example, in accordance with some implementations, the sealing ring 530 may be a slotted metal ring, such as the one described in U.S. Provisional Patent Application No. 62/162,440, entitled, "SEALING DEVICE HAVING A METAL BODY," which was filed on May 15, 2015, and is hereby incorporated by reference in its entirety.

As depicted in FIG. 5, in accordance with example implementations, the sealing ring 530 has an inner conical surface 523 that contacts an outer conical surface 522 of an outer sleeve 531 of the untethered object 100. To radially expand the untethered object 100, the object 100 shifts, or translates, the outer sleeve 522 to move the sleeve 552 further into the sealing ring 530 to radially expand the ring 530.

The untethered object 100 includes an actuator to longitudinally translate the sleeve 531 for purpose of expanding the ring sealing 530. For the example implementation of FIG. 5, the untethered object 100 includes an actuator, which is formed from an oil chamber 552, a pressurized chamber 553, and an electronic rupture disc (ERD) 550. The sleeve 531 has opposing piston surfaces in communication with the oil 552 and pressurized 553 chambers. The oil chamber 522, when filled with oil, exerts a force on the sleeve 531 to counter the pressure exerted by the pressurized chamber 553 on the sleeve 531 and retain the sleeve 531 in the position shown in FIG. 5. When the controller of the untethered object 100 determines to radially expand the object 100 so that the object 100 may be caught by a downhole seat or other obstruction, the controller actuates the ERD 550. The ERD 550 controls fluid communication between the oil chamber 520 and a dump chamber (not shown in FIG. 5) of the untethered object 100. When activated, the ERD 550 ruptures to allow the pressurized chamber 552 to longitudinally translate the sleeve 531 to radially expand the sealing ring 530. In accordance with some implementations, the untethered object 100 may include a ratchet or other similar mechanism for purposes of locking the outer sleeve 531 in place to retain the radially expanded state of the untethered object 100.

Among its other features, the untethered object 100 may contain a wiper 544 that circumscribes the sleeve 531 for purposes of enhancing the ability to pump the object 100 downhole. The untethered object 100 may also include a bullnose front end 540 that is attached to the interior housing section 504.

Figure 6A:
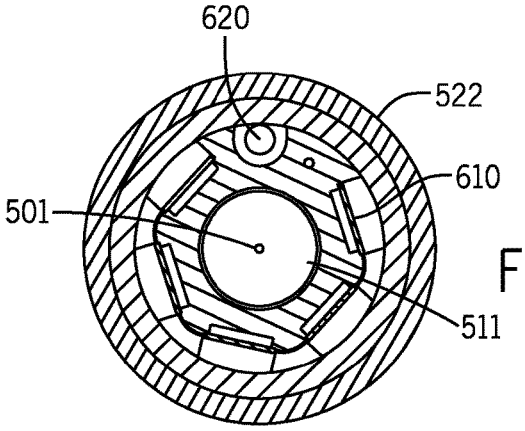
FIG. 6A is a cross-sectional view of the untethered object taken along line 6A-6A of FIG. 5 according to an example implementation.
Figure 6B:
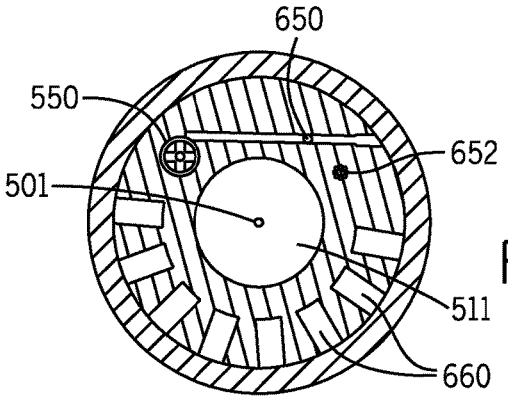
FIG. 6B is a cross-sectional view of the untethered object taken along line 6B-6B of FIG. 5 according to an example implementation.
Figure 7:
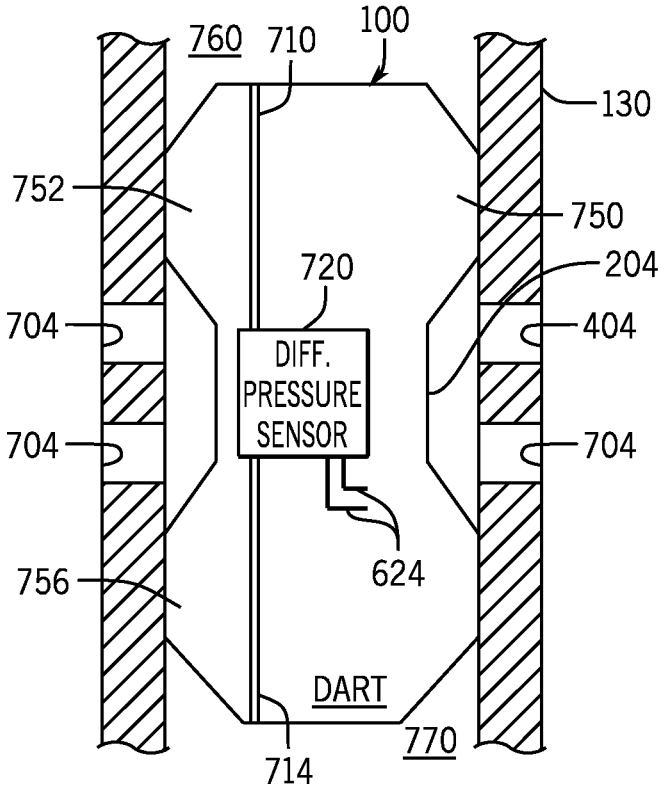
FIG. 7 is a schematic diagram illustrating a differential pressure sensor of the untethered object of FIG. 1 according to an example implementation.

Referring to FIG. 6A, in accordance with example implementations, the controller of the untethered object may be disposed on one or multiple flexible circuits 610 (or "flex circuits"), which may be disposed about the through-hole 511. Moreover, the untethered object 100 may have other components distributed about the through-hole 510, such as a battery 620, a connecting passageway 650 (FIG. 6B) between the oil and dump chambers and a connector 550 for an antenna 548 (FIG. 5) of the untethered object 100. As depicted in FIG. 5, the antenna 548 may be embedded in a dielectric material 549. As also depicted in FIG. 6B, in accordance with some implementations, the untethered object 100 may include one or multiple mill slots 660 that are arranged around the periphery of the through-hole 510 for purposes of enhancing milling of the untethered object 100 after the object 100 completes its downhole function.

In accordance with example implementations, the check ball 518 may be constructed from dissolvable or degradable materials. As an example, dissolvable, or degradable, alloys may be used similar to the alloys that are disclosed in the following patents, which have an assignee in common with the present application and are hereby incorporated by reference: U.S. Pat. No. 7,775,279, entitled, "DEBRIS-FREE PERFORATING APPARATUS AND TECHNIQUE," which issued on Aug. 17, 2010; and U.S. Pat. No. 8,211,247, entitled, "DEGRADABLE COMPOSITIONS, APPARATUS COMPOSITIONS COMPRISING SAME, AND METHOD OF USE," which issued on Jul. 3, 2012.

Figure 8:
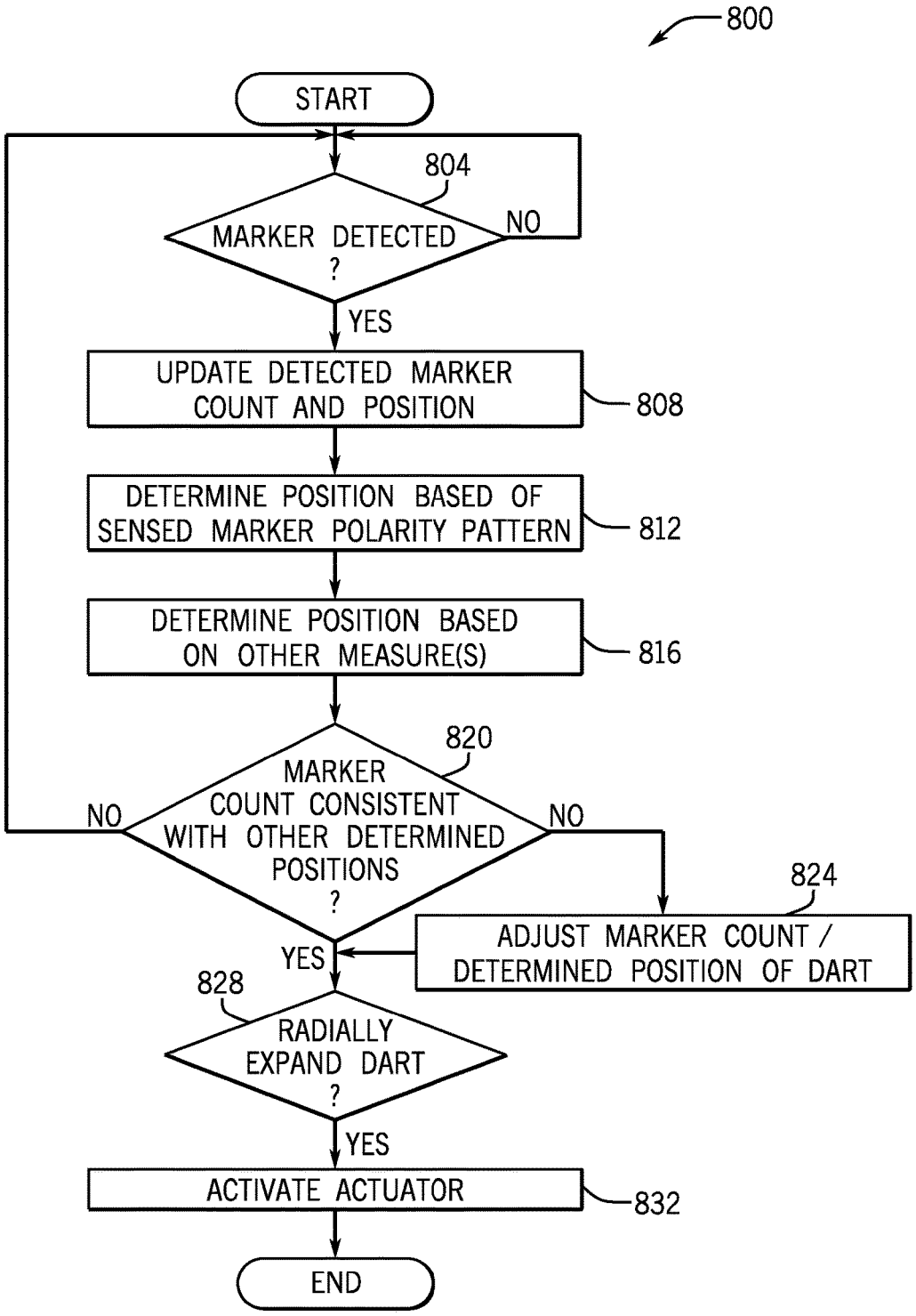
FIG. 8 is a flow diagram depicting a technique to autonomously operate an untethered object in a well to perform an operation in the well according to an example implementation.

Thus, referring to FIG. 8, in accordance with an example implementation, a technique 800 for autonomously operating an untethered object in a well, such as the untethered object 100, includes determining (decision block 804) whether a marker has been detected. If so, the untethered object 100 updates a detected marker count and updates its position, pursuant to block 808. The untethered object 100 further determines (block 812) its position based on a sensed marker polarity pattern, and the untethered object 100 may determine (block 816) its position based on one or more other measures (a sensed pressure, for example). If the untethered object 100 determines (decision block 820) that the marker count is inconsistent with the other determined position(s), then the untethered object 100 adjusts (block 824) the count/position. Next, the untethered object 100 determines (decision block 828) whether the untethered object 100 should radially expand the dart based on determined position. If not, control returns to decision block 804 for purposes of detecting the next marker.

If the untethered object 100 determines (decision block 828) that its position triggers its radially expansion, then the untethered object 100 activates (block 832) its actuator for purposes of causing the untethered object 100 to radially expand to secure the untethered object 100 to a given location in the tubing string 130. At this location, the untethered object 100 may or may not be used to perform a downhole function, depending on the particular implementation.

Figure 9:
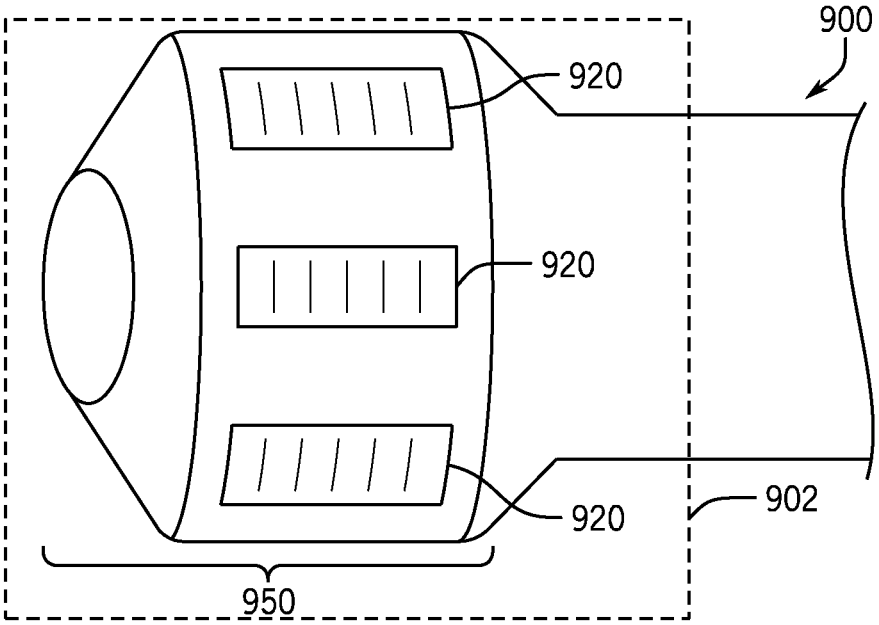
FIG. 9 is a perspective view of a deployment mechanism of an untethered object according to a further example implementation.

As yet another example, FIG. 9 depicts a portion of an untethered object 900 in accordance with another example implementation. For this implementation, a deployment mechanism 902 of the untethered object 900 includes slips 920, or hardened "teeth," which are designed to be radially expanded for purposes of gripping the wall of the tubing string 130, without using a special seat or profile of the tubing string 130 to catch the untethered object 900. In this manner, the deployment mechanism 902 may contains sleeves, or cones, to slide toward each other along the longitudinal axis of the dart to force the slips 920 radially outwardly to engage the tubing string 130 and stop the dart's travel. Thus, many variations are contemplated, which are within the scope of the appended claims.

Figure 10:
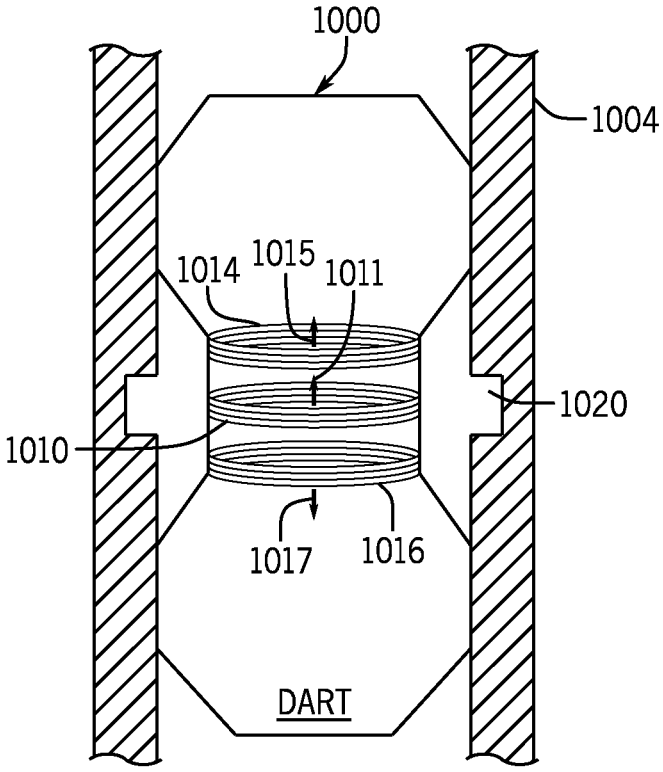
FIG. 10 is a schematic diagram of an untethered object illustrating an electromagnetic coupling sensor according to an example implementation.

Other variations are contemplated, which are within the scope of the appended claims. For example, FIG. 10 depicts an untethered object 1000 according to a further example implementation. In general, the untethered object 1000 includes an electromagnetic coupling sensor that is formed from two receiver coils 1014 and 1016, and a transmitter coil 1010 that resides between the receiver coils 1015 and 1016. As shown in FIG. 10, the receiver coils 1014 and 1016 have respective magnetic moments 1015 and 1017, respectively, which are opposite in direction. It is noted that the moments 1015 and 1017 that are depicted in FIG. 10 may be reversed, in accordance with further implementations. As also shown in FIG. 10, the transmitter 1010 has an associated magnetic moment 1011, which is pointed upwardly in FIG. 10, but may be pointed downwardly, in accordance with further implementations.

In general, the electromagnetic coupling sensor of the untethered object 1000 senses geometric changes in a tubing string 1004 in which the untethered object 1000 travels. More specifically, in accordance with some implementations, the controller (not shown in FIG. 10) of the untethered object 1000 algebraically adds, or combines, the signals from the two receiver coils 1014 and 1016, such that when both receiver coils 1014 and 1016 have the same effective electromagnetic coupling the signals are the same, thereby resulting in a net zero voltage signal. However, when the electromagnetic coupling sensor passes by a geometrically varying feature of the tubing string 1004 (a geometric discontinuity or a geometric dimension change, such as a wall thickness change, for example), the signals provided by the two receiver coils 1014 and 1016 differ. This difference, in turn, produces a non-zero voltage signal, thereby indicating to the controller that a geometric feature change of the tubing string 1004 has been detected.

Such geometric variations may be used, in accordance with example implementations, for purposes of detecting certain geometric features of the tubing string 1004, such as, for example, sleeves or sleeve valves of the tubing string 1004. Thus, by detecting and possibly counting sleeves (or other tools or features), the untethered object 1000 may determine its downhole position and actuate its deployment mechanism accordingly.

Figure 11:
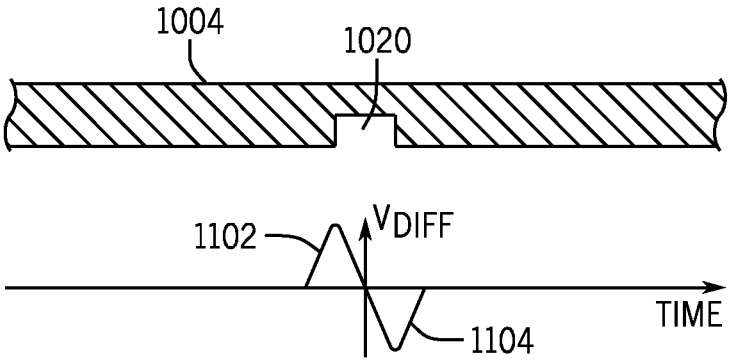
FIG. 11 is an illustration of a signal generated by the sensor of FIG. 10 according to an example implementation.

Referring to FIG. 11 in conjunction with FIG. 10, as a more specific example, an example signal is depicted in FIG. 11 illustrating a signature 1102 of the combined signal (called the"$VD_{IFF}$" signal in FIG. 11) when the electromagnetic coupling sensor passes in proximity to an illustrated geometric feature 1920, such as an annular notch for this example.

Thus, in general, implementations are disclosed herein for purposes of deploying an untethered object through a passageway of the string in a well and sensing a position indicator as the object is being communicated through the passageway. The untethered object selectively autonomously operates in response to the sensing. As disclosed above, the property may be a physical property such as a magnetic marker, an electromagnetic coupling, a geometric discontinuity, a pressure or a radioactive source. In further implementations, the physical property may be a chemical property or may be an acoustic wave. Moreover, in accordance with some implementations, the physical property may be a conductivity. In yet further implementations, a given position indicator may be formed from an intentionally-placed marker, a response marker, a radioactive source, magnet, microelectromechanical system (MEMS), a pressure, and so forth. The untethered object has the appropriate sensor(s) to detect the position indicator(s), as can be appreciated by the skilled artisan in view of the disclosure contained herein.

As another example of a further implementation, the untethered object may contain a telemetry interface that allows wireless communication with the dart. For example, a tube wave (an acoustic wave, for example) may be used to communicate with the untethered object from the Earth surface (as an example) for purposes of acquiring information (information about the object's status, information acquired by the object, and so forth) from the object. The wireless communication may also be used, for example, to initiate an action of the object, such as, for example, instructing the object to radially expand, radially contract, acquire information, transmit information to the surface, and so forth.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method comprising:

deploying an untethered object though a passageway of a string in a well, wherein the untethered object has an axial through-hole that extends along an entire longitudinal length of the untethered object, and a blocking object disposed in the axial through-hole to restrict fluid communication through the untethered object, wherein the untethered object comprises a radially contracted state and a radially expanded state;

storing a fluid in a chamber;

using the fluid in the chamber to exert a force on a mandrel to maintain the mandrel in a first position associated with the radially contracted state of the untethered object;

sensing, via a sensor disposed on the untethered object, a property of an environment of the string as the untethered object is being communicated through the passageway;

actuating an electrically actuatable rupture disc to create a flow path for the fluid to exit the chamber to allow the mandrel to move to a second position associated with the radially expanded state of the untethered object in response to the force exerted by the fluid;

selectively autonomously operating the untethered object in response to the sensing, by radially expanding the untethered object to land the untethered object in a seat of the string; and removing the blocking object to allow fluid communication through the untethered object.

2. The method of claim 1, wherein the property comprises a physical property.

3. The method of claim 2, wherein the physical property comprises a magnetic field produced by a magnetic marker, a geometric discontinuity of the string, an acoustic wave, a pressure, or a conductivity.

4. The method of claim 2, wherein the physical property comprises an element selected from the group consisting essentially of a dedicated marker, a radioactive source, a magnet, a microelectromechanical system (MEMS)-based marker and a pressure.

5. The method of claim 1, wherein deploying the untethered object comprises pushing the untethered object with fluid.

6. The method of claim 1, wherein selectively autonomously operating the untethered object comprises performing a downhole operation selected from the group consisting essentially of performing a stimulation operation, operating a downhole tool and operating a downhole valve.

7. The method of claim 1, wherein removing the blocking object comprises milling out the blocking object.

8. The method of claim 1, wherein removing the blocking object comprises dissolving the blocking object.

9. The method of claim 1, further comprising:

flowing well fluid uphole through the axial through-hole.

10. The method of claim 1, further comprising:

running well equipment through the axial through-hole.

11. The method of claim 1, wherein sensing the property comprises sensing a repeating pattern along the string.

12. The method of claim 1, further comprising using the blocking object to check a fluid from flowing downhole through the untethered object.

13. An apparatus usable with a well, comprising:

a body comprising a longitudinal inner passageway extending through an entire longitudinal length of the body;

a blocking member disposed in the longitudinal inner passageway to check fluid from flowing in a predefined direction through the longitudinal inner passageway;

a sensor disposed on the body to sense a property of an environment of the well as the blocking member is being communicated through the longitudinal inner passageway;

a radially expandable element disposed on the body;

a controller disposed on the body to selectively autonomously control the radially expandable element to land the body in a downhole restriction in response to the sensing;

a mandrel having a surface to receive a force exerted by downhole well fluid, the mandrel having a first position associated with a radially contracted state of the radially expandable element and a second position associated with a radially expanded state of the radially expandable element;

a chamber storing a fluid; and an electrically actuatable rupture disc, wherein the fluid stored in the chamber exerts a force on the mandrel to maintain the mandrel in the first position, and the controller is configured to actuate the electrically actuatable rupture disc to create a flow path for the fluid to exit the chamber to allow the mandrel to move to the second position in response to the force exerted by the downhole well fluid.

14. The apparatus of claim 13, wherein the body further comprises milling slots disposed at least partially around the longitudinal inner passageway.

15. The apparatus of claim 13, further comprising flexible circuit boards attached to the body, wherein the controller is disposed on the flexible circuit boards.

16. The apparatus of claim 13, wherein the sensor comprises an antenna winding.

17. An apparatus usable with a well, comprising:

a string comprising a passageway; and an untethered object adapted to be deployed in the passageway such that the untethered object travels in the passageway, the untethered object comprising:

a longitudinal inner passageway extending through an entire longitudinal length of the untethered object;

a degradable check valve element disposed in the longitudinal inner passageway, the degradable check valve element being adapted to degrade in a downhole well environment at a faster rate than other components of the untethered object;

a sensor configured to sense a property of an environment of the string as the untethered object is being communicated through the passageway of the string; and a radially expandable element;

a controller disposed on the untethered object and coupled to the sensor, wherein the controller is configured to selectively autonomously control the radially expandable element to land the untethered object in a seat of the string in response to the sensing;

a mandrel having a surface to receive a force exerted by downhole well fluid, the mandrel having a first position associated with a radially contracted state of the radially expandable element and a second position associated with a radially expanded state of the radially expandable element;

a chamber storing a fluid; and an electrically actuatable rupture disc, wherein the fluid stored in the chamber exerts a force on the mandrel to maintain the mandrel in the first position, and the controller is configured to actuate the electrically actuatable rupture disc to create a flow path for the fluid to exit the chamber to allow the mandrel to move to the second position in response to the force exerted by the downhole well fluid.

18. The apparatus of claim 17, wherein the radially expandable element comprises a slotted metal ring.

19. The apparatus of claim 17, wherein the property comprises a physical property selected from the group consisting essentially of:

a magnetic field produced by a magnetic marker;

a geometric discontinuity of the string;

an acoustic wave;

a pressure;

a conductivity;

a dedicated marker;

a radioactive source;

a magnet, and a microelectromechanical system (MEMS)-based marker.

* * * * *